US007575118B2

(12) United States Patent
Richter et al.

(10) Patent No.: US 7,575,118 B2
(45) Date of Patent: Aug. 18, 2009

(54) DEVICE FOR TRANSPORTING AND/OR STORING

(75) Inventors: Gunter Richter, Altenkirchen (DE); Hans-Ulrich Hahn, Neustadt (DE)

(73) Assignee: Honeywell International Inc., Morristown, NJ (US)

( * ) Notice: Subject to any disclaimer, the term of this patent is extended or adjusted under 35 U.S.C. 154(b) by 319 days.

(21) Appl. No.: 10/477,470

(22) PCT Filed: May 10, 2002

(86) PCT No.: PCT/EP02/05194

§ 371 (c)(1),
(2), (4) Date: Jun. 1, 2004

(87) PCT Pub. No.: WO02/092460

PCT Pub. Date: Nov. 21, 2002

(65) Prior Publication Data

US 2004/0195129 A1 Oct. 7, 2004

(30) Foreign Application Priority Data

May 11, 2001 (DE) ..... 201 07 962

(51) Int. Cl.
*B65D 19/00* (2006.01)

(52) U.S. Cl. ..... 206/386; 220/23.87

(58) Field of Classification Search ..... 206/386, 206/524.1, 524.2, 524.6; 220/1.5, 1.6, 23.87, 220/23.91, 668; 361/212, 215

See application file for complete search history.

(56) References Cited

U.S. PATENT DOCUMENTS

| | | | | |
|---|---|---|---|---|
| 4,173,288 | A * | 11/1979 | Schutz | 220/1.5 |
| 5,111,937 | A * | 5/1992 | Schutz | 206/386 |
| 5,253,777 | A * | 10/1993 | Schutz | 220/571 |
| 5,447,250 | A * | 9/1995 | Schutz | 220/62.11 |
| 5,634,561 | A | 6/1997 | Pfeiffer | 206/719 |
| 6,533,122 | B1 * | 3/2003 | Plunkett | 206/600 |
| 6,723,400 | B1 * | 4/2004 | Ishio et al. | 428/35.7 |
| 6,902,061 | B1 * | 6/2005 | Elstone | 206/600 |
| 2004/0050850 | A1 * | 3/2004 | Richter | 220/495.06 |

FOREIGN PATENT DOCUMENTS

| | | |
|---|---|---|
| DE | 29 14 478 | 10/1980 |
| DE | 20009113 | 9/2000 |
| GB | 2219270 | 4/1988 |
| GB | 2314555 A * | 1/1998 |
| WO | WO 01/89942 | 11/2001 |

* cited by examiner

*Primary Examiner*—J. Gregory Pickett
(74) *Attorney, Agent, or Firm*—Scott Jacobson

(57) ABSTRACT

The present invention relates to a device for transporting and storing of a powder or liquid medium, comprising (a) a structurally stable outer container having an electrically conducting inner surface, a top side that is open and capable of receiving an inner container, and a bottom section comprising a plurality of recesses wherein each recess can receive a pronged platform of a cargo moving device; and (b) an inner container capable of holding said medium having a top section, an opening in said top section for filing and discharging said medium, and one or more walls. These walls are made of a plastic material, are adjacent to said inner surface of said outer container, and have an outer surface. The outer surface has at least one electrically conductive layer that is in electrical contact with the outer container's inner surface. Moreover, invention could optionally include a plastic pallet having an electrically conductive layer that is in contact with the outer container.

7 Claims, 3 Drawing Sheets

DEVICE FOR TRANSPORTING AND/OR STORING

CROSS REFERENCES TO RELATED APPLICATIONS

This application is the U.S. national phase entry which claims priority benefit under 35 U.S.C. § 371 of PCT International Application Serial No. PCT/EP02/05194 filed May 10, 2002, which, in turn, claims priority of German Application DE 201 07 962.3 filed on May 11, 2001.

FIELD OF INVENTION

This invention relates to a device for transporting and storing a powder or liquid medium, the device comprising (a) an outer container which is predominantly stable with respect to its shape, open on the top side, and is formed pallet-like in its bottom, and (b) an inner container for accommodating the medium, which comprises a top section having an opening for filling and discharging the medium, said inner container being adjacent to the outer container's inner surface and being, if necessary, secured by a covering element that may be attached to the outer container, wherein the inner container has at least one wall made of plastic materials.

BACKGROUND

A variety of conventional devices for transporting and storing powder and liquid medium, including those comprising an outer container and inner container having a volume of several hundred liters, are used more and more often in various application. In many of such conventional devices, the inner container comprises plastic materials, wherein the wall can comprise one or several layers. In addition, the inner container has an opening for filling and discharging through its so-called top section and is secured in many cases by means of a covering element in the outer container. The inner container is often realized with a relatively thin wall and is enclosed within an outer container for the purpose of its stabilization. The outer container may comprise metal or plastic materials. In most cases, the outer container is arranged on a pallet that comprises wood, metal or plastic materials.

Applicants have recognized that a metallic outer container is undesired in many fields, in particular in the fields of chemical industry and food processing. For example, in fields in which acids and/or corrosive materials are used, the danger of corroding exists if the outer container is made of steel. Such danger of corroding may be avoided if the outer container is made of stainless steel. However, such a container comprising stainless steel is expensive and lavish with respect to its making.

To eliminate the aforementioned disadvantages, the outer container of certain conventional devices have been produced from plastic materials, wherein the wall of said container can be made of one or of several layers as well. Such an outer container made of plastic materials tends to be inexpensive in its production and not subject to corrosion.

However, Applicants have further recognized that there are fields in industry in which conventional storage devices that have an inner container and/or outer container being made of plastic materials cannot be used for reasons of security with respect to explosions. By using plastic materials, the danger exists that electrostatic charging may occur due to poor electrical conductance. This may also lead to electrostatic surface charge effects.

SUMMARY OF THE INVENTION

Therefore, the object of the present invention is to design a device for transporting and storing a powder or a liquid medium, wherein at least the inner container of said device comprises plastic materials, characterized in that electrostatic surface charge effects are less likely to occur than in conventional devices.

According to the invention, this object is met by using a device as described herein, wherein the parts of the device that comprise plastic materials have at least one electrically conducting layer on their outer surfaces and wherein said electrically conducting layers are mutually electrically conductive connected.

Furthermore, the invention relates to a device for transporting and storing a powder or liquid medium, comprising (a) a structurally stable outer container having an electrically conducting inner surface, a top side that is open and capable of receiving an inner container, and a bottom section comprising a plurality of recesses wherein each recess can receive a pronged platform of a cargo moving device; and (b) an inner container capable of holding said medium, the inner container having a top section, an opening in said top section for filing and discharging said medium, and one or more walls. At least one wall of the container is made of a plastic material, is adjacent to the inner surface of the outer container, and has an outer surface. The outer surface of the inner container has at least one electrically conductive layer that is in electrical contact with the outer container's inner surface. Moreover, invention could optionally include a plastic pallet having an electrically conductive layer that is in contact with the outer container.

By using this design, it is possible to conduct electrical charges away from the container so that electrostatic surface charge effects cannot occur. If the electrically conductive layer comprises a plastic material mixed with an electrically conducting filling material, this layer may be kept extremely thin. This leads to the advantage that relatively little of the considerably expensive electrically conducting plastic material is needed. Also, the electrically conducting layer does not need to display good structural properties.

According to certain preferred embodiments of the present invention, the device is characterized in that the electrically conductive layer comprises an electrically conductive filling material mixed with plastic materials.

Furthermore, in certain preferred embodiments, the device is characterized in that the electrically conductive layer has an electrical resistance of equal to or less than $10^7$ Ohms.

Furthermore, in certain preferred embodiments, the device is characterized in that the non-conductive inner layer of the inner container has a wall thickness of no more than three mm.

Furthermore, in certain preferred embodiments, the device is characterized in that the inner layer of the inner container comprises a plastic material of high purity that releases less than 100 parts per trillion of each metallic impurity into the medium contained within the inner container.

Furthermore, in certain preferred embodiments, the device has a tube for filling and discharging medium within the inner container characterized in that the tube for filling and discharging comprises a plastic material that is mixed with an electrically conductive filling material.

The present invention is further explained by making reference to the following figures.

DETAILED DESCRIPTION OF THE INVENTION AND PREFERRED EMBODIMENTS

Figure 1:
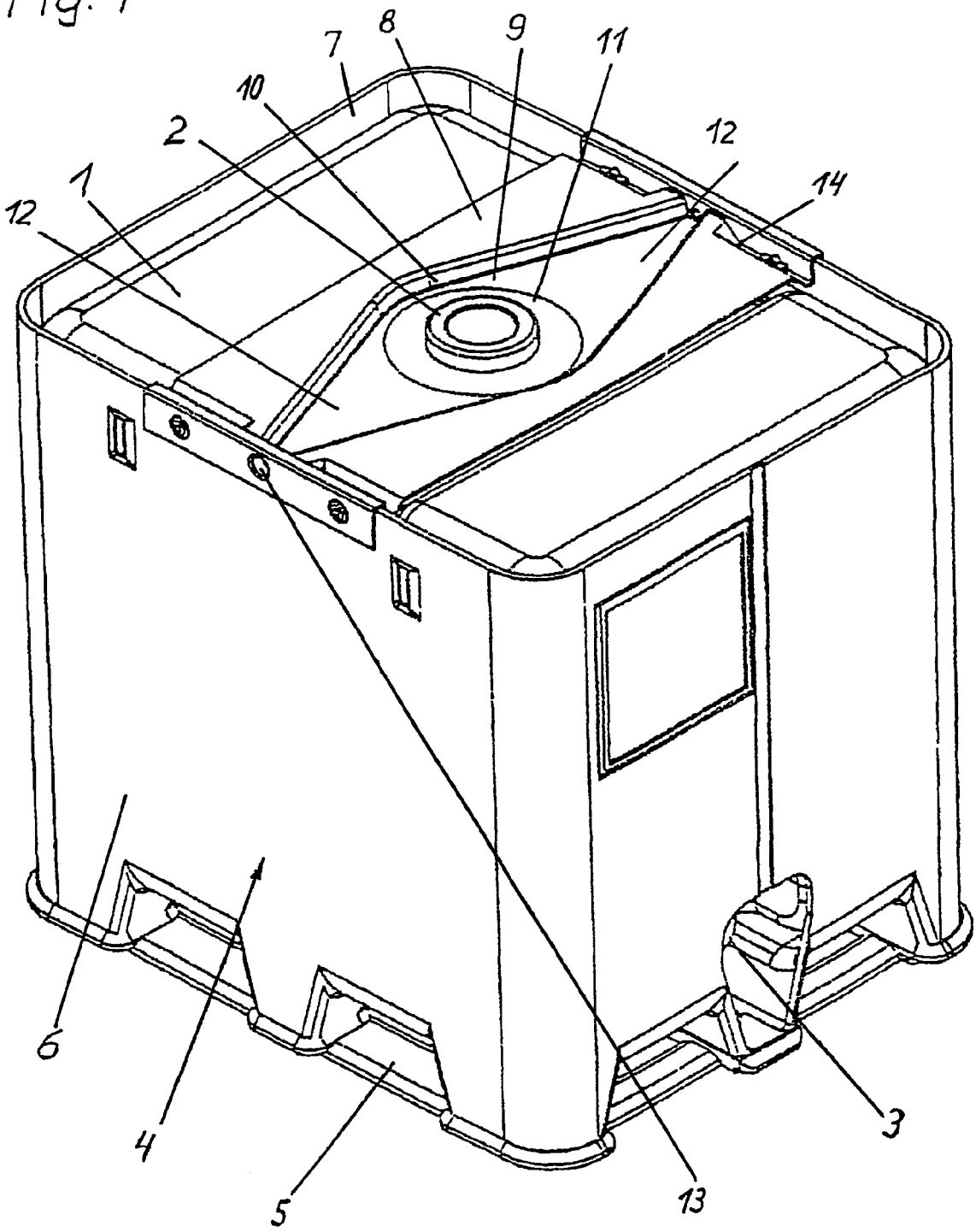
FIG. 1A depiction of the device according to the invention in perspective.
Figure 2:
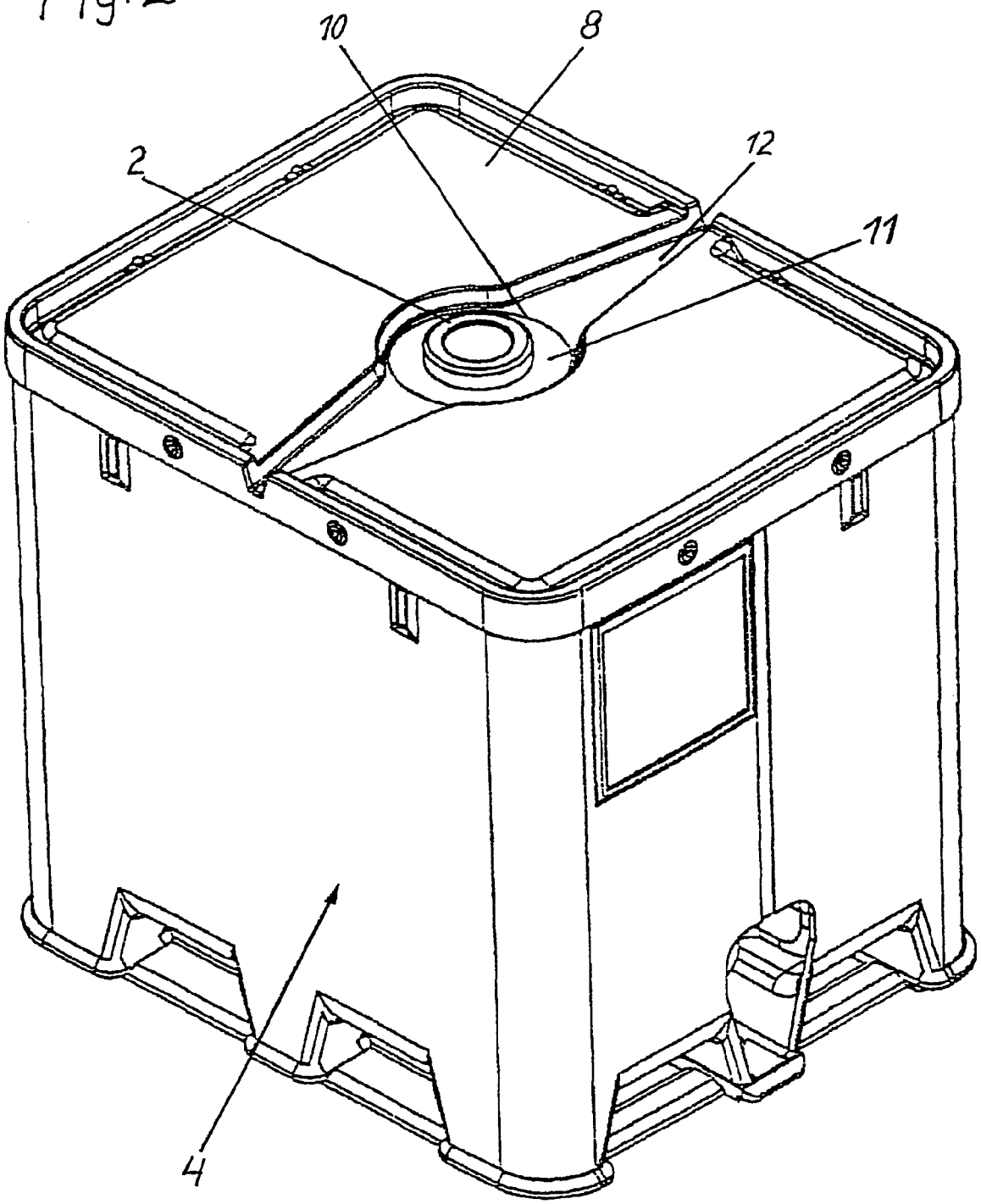
FIG. 2A different embodiment of the device according to the invention.

A device for the transport and the storage of a powder or liquid medium is shown in FIGS. 1 and 2, respectively. This device comprises an outer container 4 that is rectangular-box-shaped and is made of a plastic material in the case of the example shown. However, this outer container 4 may also be made of metal, e.g. of sheet metal. The bottom of the outer container 4 is either formed as a pallet or rests on a pallet 5. The outer container 4 is designed to be open on the top. The wall of this outer container 4 is made of a plastic material and may be designed to have one or several layers. The outer container 4 accommodates a relatively thin-walled inner container 1 that comprises a plastic material of high purity that is suited to accommodate the medium. The purity of the plastic material of the inner layer is sufficiently high so that said plastic material releases less than 100 ppt of metallic impurities, possibly contained within the plastic material, into the medium. The inner container 1 not only rests on the bottom of the outer container 4, but also on the inner side of the jacket body 6 of the outer container 4. The inner container 1 has an opening for filling located on its upper bottom that is formed by means of a spout 2 in combination with the outer thread, wherein said opening is closed by means of a cover. This opening for filling may also be used as an opening for discharging, whereby it is necessary to place a discharge tube onto the spout 2, wherein said discharge tube may also be used as a filling tube and is immersed into the medium that is contained inside the inner container. This tube for filling and discharging is advantageously made of an electrically conductive plastic material that is mixed with an electrically conductive filling material. In the case of the examples shown, the inner container 1, however, contains in its lower area an opening for discharge 3 that is equipped with a closing device, wherein said opening for discharge is located in a gap of the outer container 4.

In the drawings with respect to the examples of FIGS. 1 and 2, the upper rim 7 of the outer container 4 protrudes over the upper bottom of the inner container 1 by a given margin. A covering element 8 with a rim for attaching 14 is plugged onto this rim 7. Said covering element is advantageously made of plastic materials. According to FIG. 1 of the drawing, said covering element 8 only covers a part of the top of the inner container 1, wherein in the case of FIG. 2 the covering element 8 completely covers the top of the inner container 1 and therefore also the outer container 4. In the examples shown in FIGS. 1 and 2, the attaching rim 14 of the covering element 8 can be attached to the rim 7 of the outer container 4 by screwing. Furthermore, the covering element 8 has an indentation 9 that surrounds the spout 2 of the inner container 1 by means of an opening 10, wherein said indentation lies on top of a sealing device 11 on the upper bottom of the inner container 1. Furthermore, an overflow-groove 12 is shaped into the covering element 8 allowing, for example, that a liquid medium being spilled during the process of filling can be guided to the outside and discharged via the openings 13.

Figure 3:
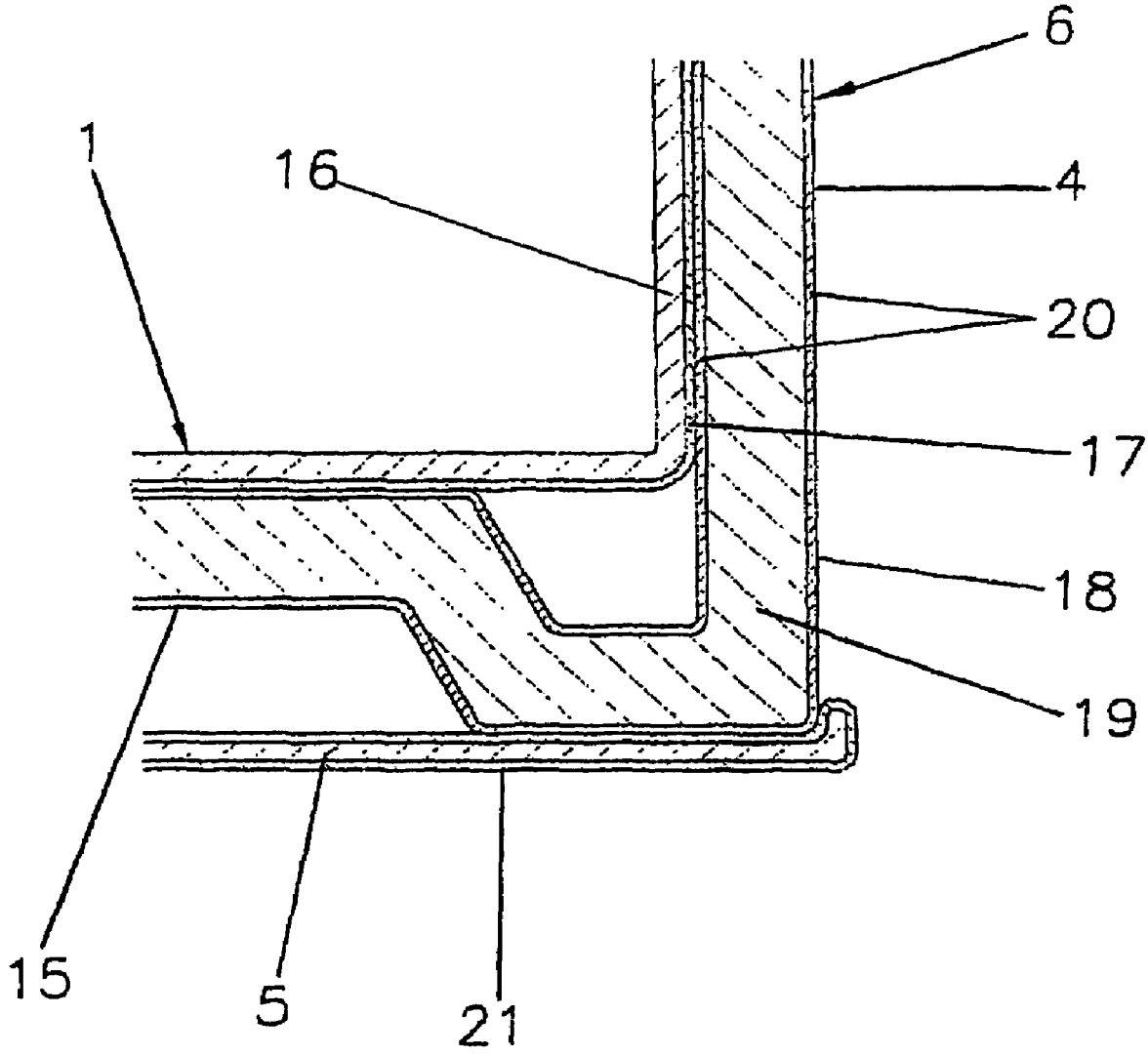
FIG. 3A cross-sectional view of the lower area of the edge of a device according to the invention.

As demonstrated in FIG. 3, the inner container 1 on the one hand rests on the bottom 15 of the outer container 4 and lies flush with the inner area of the jacket body 6. However, the depiction of FIG. 3 also shows that the wall 16 of the inner container 1 that is made of a plastic material and that may display a thickness of up to three millimeters is equipped at its outer surface with a layer 17 made of an electrically conductive plastic material. This layer 17 that is made of plastic material is realized as an extremely thin layer since the layer does not have to perform any structural function. Conductivity is achieved by means of adding an electrically conductive filling material to the plastic material. The electric resistivity of layer 17 is equal to or less than $10^7$ Ohms.

FIG. 3 of the drawing also shows the set-up of the wall 18 of the outer container 4. Said wall comprises a supporting layer 19 that is made of a plastic material and that may be realized in one or in several layers. In addition, this wall 18 also has an outer layer 20 that is made of an electrically conducting plastic material, similarly to the case of the inner container 1. Said layer also displays an extremely small thickness. This layer 20 also has no structural functions to perform. In the case of the example chosen, the outer container 4 rests on the pallet 5, wherein said pallet is connected to the outer container 4 by means of a clip. In the example chosen, this pallet 5 also comprises a plastic material, wherein the outer surface is equipped with a layer 21 made of an electrically conductive plastic material. The covering element 8 may also be made according to a similar design, i.e. contain an electrically conductive layer. This ensures that no electrostatic charging may occur, possibly leading to electrostatic surface charges.

The invention claimed is:

1. A device for transporting and storing a powder or liquid medium, comprising:

a structurally stable outer container comprising (i) at least one wall constructed of a supporting plastic layer and having an electrically conducting inner surface and an electrically conducting outer surface that are in mutual electrical contact, (ii) a top side that is open and capable of receiving an inner container, and (iii) a bottom section comprising a plurality of recesses wherein each recess is capable of receiving a pronged platform of a cargo moving device; and a thin-walled inner container disposed within said outer container, said inner container comprising (i) top section having an opening for filling and discharging a liquid or powder medium, (ii) at least one wall having a non-conductive plastic inner layer having a thickness of no more than 3 millimeters, and (iii) an electrically conductive outer layer having a surface in electrical contact with said outer container's inner surface, wherein said electrically conductive surfaces are constructed of a mixture of plastic material and an electrically conductive filler.

2. The device according to claim 1, further comprising a plastic pallet having an electrically conductive layer, said electrically conductive layer being in contact with said outer container.

3. The device according to claim 1, further comprising a covering element attached to said outer container capable of covering said inner container.

4. The device according to claim 1, wherein said at least one electrically conductive surface of said outer surface of said inner container has an electrical resistance of equal to or less than $10^7$ Ohms.

5. The device according to claim 1, wherein said wherein said electrically conductive inner surface of said outer container has an electrical resistance of equal to or less than $10^7$ Ohms.

6. The device according to claim 1, wherein said electrically conductive outer surface of said outer container has an electrical resistance of equal to or less than $10^7$ Ohms.

7. The device according to claim 1, wherein said inner layer of said inner container releases less than 100 parts-per-trillion of each metallic impurity into a medium in the inner container.

* * * * *

UNITED STATES PATENT AND TRADEMARK OFFICE

CERTIFICATE OF CORRECTION

PATENT NO. : 7,575,118 B2
APPLICATION NO. : 10/477470
DATED : August 18, 2009
INVENTOR(S) : Richter et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 662 days.

Signed and Sealed this

Seventh Day of September, 2010

David J. Kappos

David J. Kappos
*Director of the United States Patent and Trademark Office*